US006814623B2

(12) United States Patent
Hashiba

(10) Patent No.: US 6,814,623 B2
(45) Date of Patent: Nov. 9, 2004

(54) CONNECTOR FOR SPEAKER

(75) Inventor: Kazuo Hashiba, Tendo (JP)

(73) Assignees: Pioneer Corporation, Tokyo-to (JP); Tohoku Pioneer Corporation, Yamagata-ken (JP)

( * ) Notice: Subject to any disclaimer, the term of this patent is extended or adjusted under 35 U.S.C. 154(b) by 56 days.

(21) Appl. No.: 10/270,580

(22) Filed: Oct. 16, 2002

(65) Prior Publication Data

US 2003/0077945 A1 Apr. 24, 2003

(30) Foreign Application Priority Data

Oct. 23, 2001 (JP) ..... P2001-325106

(51) Int. Cl.[7] ..... H01R 13/502
(52) U.S. Cl. ..... 439/660; 439/66
(58) Field of Search ..... 439/66, 660

(56) References Cited

U.S. PATENT DOCUMENTS 4,795,369 A 1/1989 Vandame
5,091,958 A 2/1992 Sakamoto et al.
6,068,519 A * 5/2000 Lok ..... 439/660
6,246,762 B1 6/2001 Goyal et al.
6,299,457 B1 * 10/2001 Snyder ..... 439/66
6,341,962 B1 * 1/2002 Sinclair ..... 439/66
6,491,527 B1 * 12/2002 Smith ..... 439/66

FOREIGN PATENT DOCUMENTS

| | | |
|---|---|---|
| EP | 0 755 165 A1 | 1/1997 |
| JP | 09-009381 | 1/1997 |
| JP | 2001-102116 | 4/2001 |
| JP | 2001-119775 | 4/2001 |
| WO | WO 01/45213 A1 | 6/2001 |

* cited by examiner

*Primary Examiner*—Gary Pauman
*Assistant Examiner*—James R. Harvey
(74) *Attorney, Agent, or Firm*—Nixon & Vanderhye P.C.

(57) ABSTRACT

A connector for a speaker includes a box-shaped member having a block piece and an engaging member through which the box-shaped member is secured to a frame member of the speaker and a conductive wire in form of a coil spring having one end contacting a terminal provided for the frame member of the speaker and another one end projecting outward of the box-shaped member so as to contact a substrate of the speaker.

7 Claims, 5 Drawing Sheets

CONNECTOR FOR SPEAKER

BACKGROUND OF THE INVENTION

1. Field Pertinent of the Invention

The present invention relates to a connector for a speaker which is mounted to a portable equipment of such as cellular phone (or portable phone), PDA (Personal Digital Assistant) and the like and also relates to an assembly, in combination, of a speaker and a connector.

2. Related Background Art

A connector of a known speaker is disclosed in, for example, Japanese Patent Laid-open (KOKAI) Publication No. 9381/1997, No. 102116/2001 or No. 119775/2001.

That is, the Japanese Patent Laid-open Publication No. 9381/1997 (Reference 1) discloses a speaker in which a projection is formed to a terminal of the speaker, and a connector is secured to a front end of a conductive wire connected to a substrate disposed at an external portion of the speaker so as to connect the connector to the projection of the terminal of the speaker.

Further, the Japanese Patent Laid-open Publication No. 102116/2001 (Reference 2) discloses a speaker in which a contact base is disposed between a substrate and a speaker, and a conductive leaf (plate) spring is attached to the contact base in a manner such that both end portions of the leaf spring are contacted respectively to the substrate and the speaker.

Furthermore, the Japanese Patent Laid-open Publication No. 119775/2001 (Reference 3) discloses a speaker in which one end of a conductive wire in form of coil spring is connected to a substrate and another one end of the coil spring wire is pushed against a terminal of the speaker.

The speakers of the conventional structures mentioned above, however, provide following defects or inconveniences.

That is, for the speaker of the Reference 1, the connector is secured to the front end of the conductive wire connected to the external substrate, the assembling thereof requires much time, hence being troublesome and increasing manufacturing cost. For the speaker of the Reference 2, it is obliged to prepare a contact base having a large and complicated shape for mounting the leaf spring, so that much space will be required and the manufacturing cost is hence increased. Furthermore, in the speaker of the Reference 3, since the substrate and the conductive wire in form of coil spring is integrated, in a case where a distance between the speaker and the substrate differs according to the types of the speakers, it is required to prepare substrates provided with coil spring-shaped wires every time when the different types of speakers are used, thus being troublesome and inconvenient.

SUMMARY OF THE INVENTION

An object of the present invention is therefore to substantially eliminate defects or inconveniences encountered in the prior art mentioned above and to provide a connector for a speaker capable of being easily assembled with low cost.

Another object of the present invention is to provide an assembly, in combination, of a speaker and the connector of the above character.

The above and other objects can be achieved according to the present invention by providing, in one aspect, a connector for a speaker having a frame member comprising:

a box-shaped member including a block piece and an engaging member through which the box-shaped member is secured to the frame member of the speaker; and a conductive wire in form of a coil spring supported by the box-shaped member, the conductive wire having one end contacting a terminal provided for the frame member of the speaker when the box-shaped member is secured to the frame member of the speaker and another one end projecting outside the box-shaped member, when secured to the frame member, so as to contact a substrate of the speaker.

According to this structure, by fixing the box-shaped member to the frame of the speaker by means of engaging member, one end of the coil spring conductive wire contacts a terminal of the speaker frame member, so that the coil spring-shaped conductive wire can be easily connected to the speaker. In addition, since the other end of the conductive wire projects outward of the box-shaped member, when the speaker approaches a speaker side substrate, the conductive wire is elastically deformed and the other end thereof contacts this substrate. Accordingly, even in the case where the distance between the speaker and the substrate differs in kinds or types of personal digital assistant such as PDA or speaker to be used, such case can be dealt with only by exchanging the box-shaped member with another member having different length of the coil spring conductive wire without preparing a new substrate.

In preferred embodiments of this aspect, the engaging member of the box-shaped member comprises a pair of engagement pieces projecting outward from the box-shaped member and the speaker has a plate member projecting from the frame member thereof, the engagement pieces being engaged with both side edge portions of the projected plate member.

The coil spring-shaped conductive wire has one end secured to the box-shaped member. The conductive wire preferably comprises a coil portion, a linear portion extending from one end of the coil portion along the block piece of the box-shaped member, a bent portion bent at the distal end of the linear portion, and a contact portion formed at another end of the coil portion. The block piece of the box-shaped member may be formed with a groove to which the linear portion of the conductive wire is fitted and a hole into which the bent portion of the conductive wire is fitted.

The box-shaped member may be formed with a pair of through holes into which a pair of the conductive wires are fitted, respectively.

The box-shaped member is integrally formed of synthetic resin.

According to the above preferred embodiments, since the paired engagement pieces are engaged with both side edge portions of the projection piece projecting from the frame member of the speaker, the conductive wire can be connected through one-touch operation to the speaker by pushing the box-shaped member against the plate member, thus improving and simplifying the wiring working.

Furthermore, since one end of the conductive wire can be firmly secured to the box-shaped member, the wiring working can be further simplified and made easy.

According to the embodiment in which the paired conductive wires are accommodated in the through holes formed to the box-shaped member, the coil spring-shaped conductive wires can be smoothly elastically deformed to thereby properly contact the terminal of the speaker and the substrate.

In another aspect of the present invention, there is also provided an assembly comprising, in combination, a speaker and a connector for the speaker, the speaker including a frame member and a projection piece, in form of plate, projecting outward from the frame member, and the connector including a box-shaped member provided with a block piece and an engaging member through which the box-shaped member is secured to the frame member of the speaker, and a conductive is wire in form of a coil spring supported by the box-shaped member, the conductive wire having one end contacting a terminal provided for the frame member of the speaker and another one end projecting outward of the box-shaped member so as to contact a substrate of the speaker.

The nature and further characteristic features of the present invention may be made further clear from the following descriptions made with reference to the accompanying drawings.

DESCRIPTION OF THE PREFERRED EMBODIMENT

One preferred embodiment of a connector for a speaker and an assembly in combination thereof according to the present invention will be described hereunder with reference to the accompanying drawings.

Figure 1:
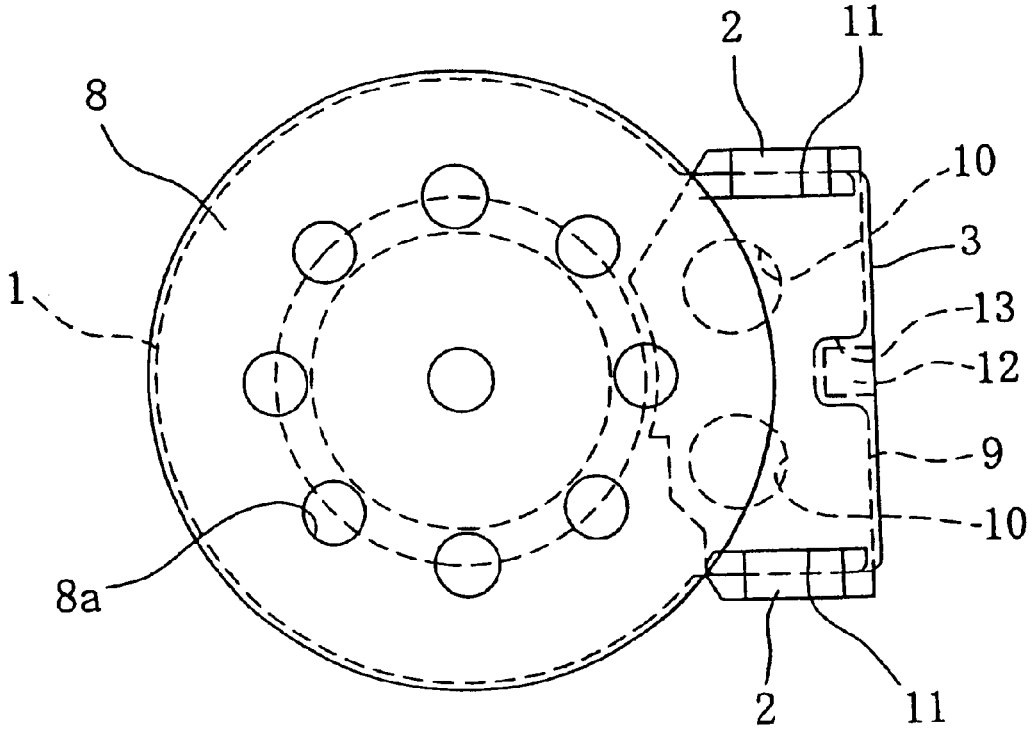
FIG. 1 is a plan view of a speaker provided with a connector according to one embodiment of the present invention.
Figure 2:
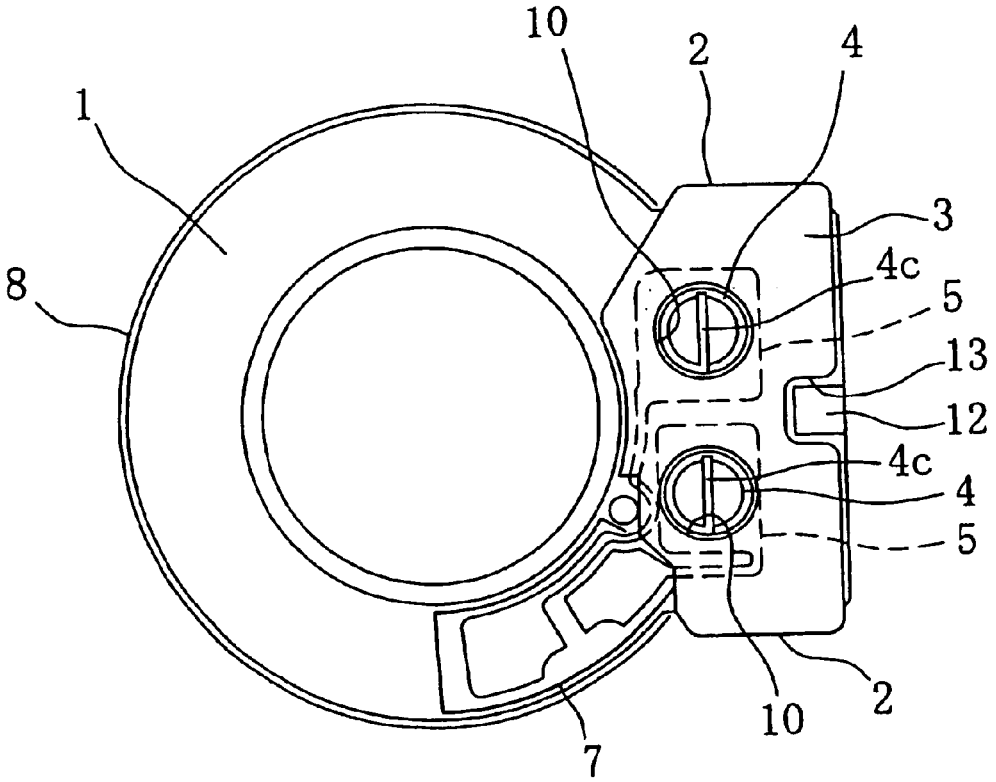
FIG. 2 is a backside view of the speaker shown in FIG. 1.
Figure 3:
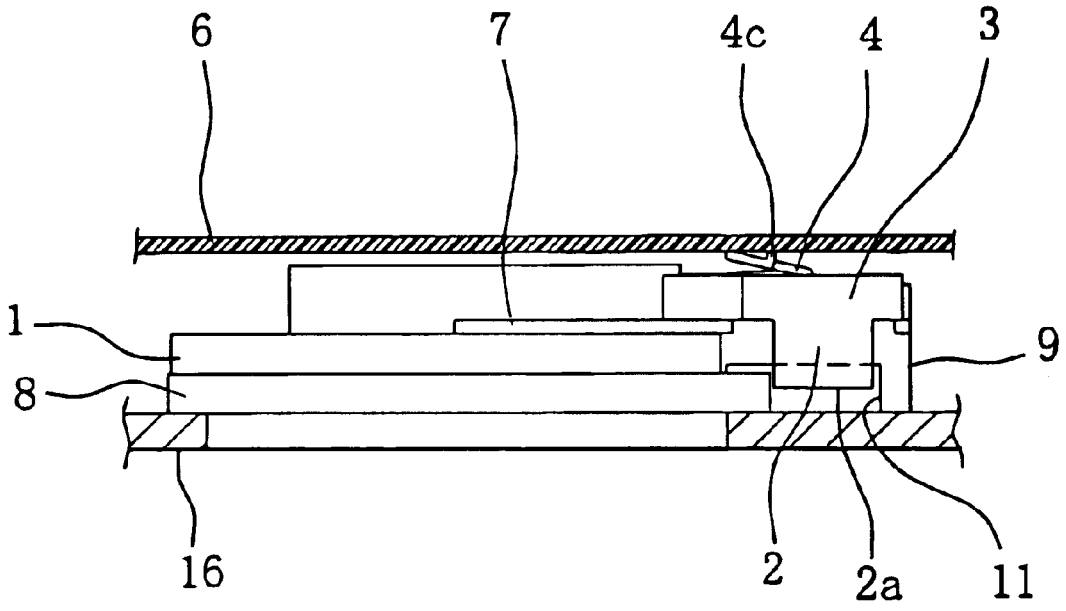
FIG. 3 is a front view of the speaker shown in FIG. 1 in a state that the speaker is set on a substrate.

Referring to FIGS. 1 to 3, a connector is mounted to a speaker. That is, the connector has a box-shaped member 3, which is fixedly mounted to a frame member 1 of the speaker through engaging pieces 2. The connector is also provided with conductive wires 4 in form of coil spring (called hereinlater merely a coil spring wire 4) supported by the box-shaped member 3 (which also may be called merely a box member). When the box member 3 is fixed to the speaker frame member 1, one end of the coil spring wire 4 contacts a terminal 5 provided for the speaker frame member 1 in a state that another one end of the coil spring wire 4 projects outside of the box-shaped member so as to be contacted to a substrate 6 disposed to an external portion (outside) of the speaker.

Figure 4A:
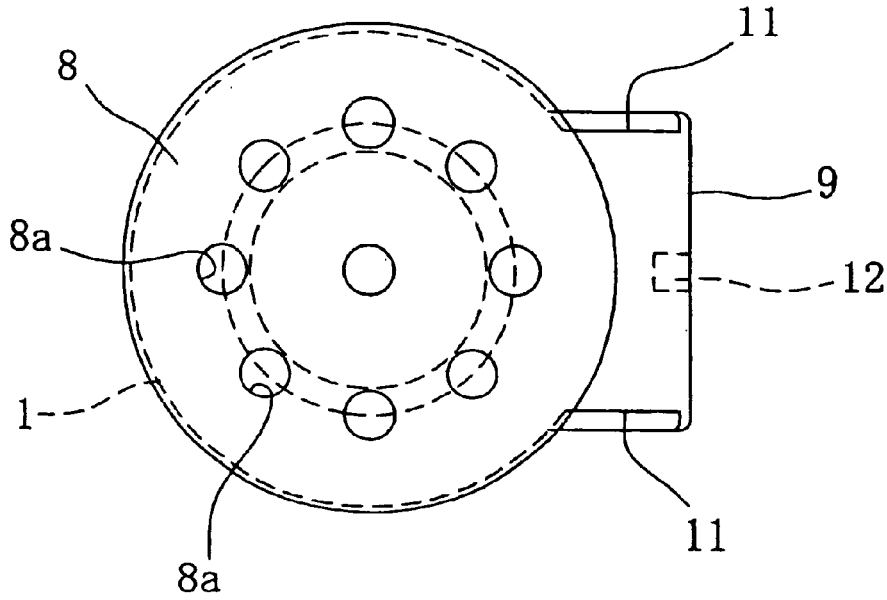
FIGS. 4A, 4B and 4C show plan, back and front views of the speaker, similar to FIGS. 1 to 3, respectively, from which, however, a connector is removed.
Figure 4B:
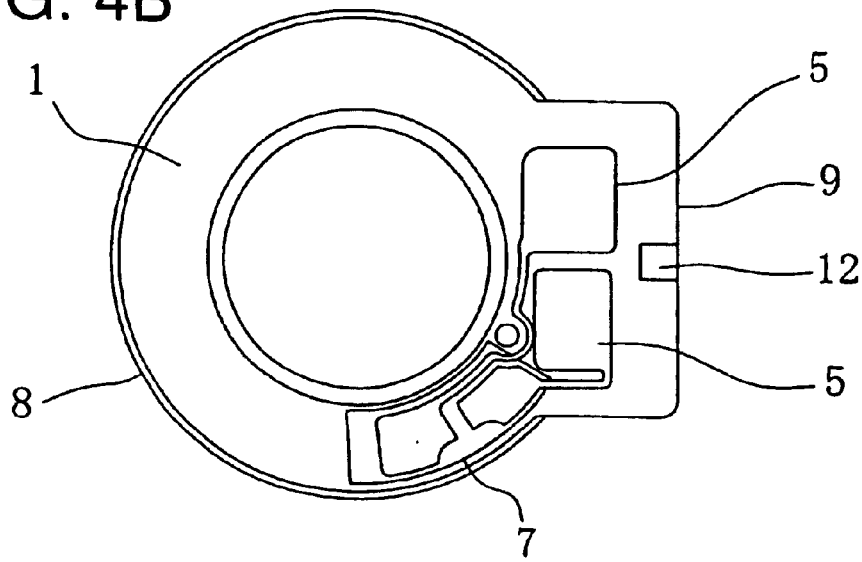
Figure 4C:
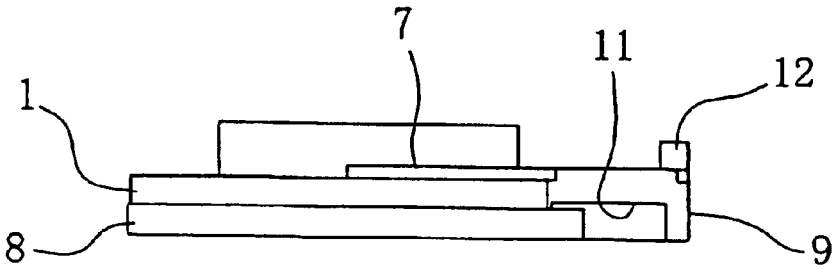

This speaker is for portable equipment such as cellular (portable phone or cellar phone) or PDA, and as shown in FIG. 4, the speaker is provided with a frame or frame structure 1 having substantially disc shape. Inside the frame structure 1, is disposed an oscillation plate, not shown, and a speaker side substrate 7 including an electromagnetic circuit and the like. The frame structure 1 is formed from a synthetic resin material and has a surface, corresponding to the oscillation plate, which is covered by a cover 8 having holes 8*a* through which sound is allowed to be transmitted. This disc-shaped frame 1 has an side edge portion from which a plate member 9 projects sideways as shown, and a terminal 5 of the electromagnetic circuit is formed to the back surface of this plate member 9. The speaker side substrate including this terminal 5 is covered by a protecting means, not shown.

Figure 5:
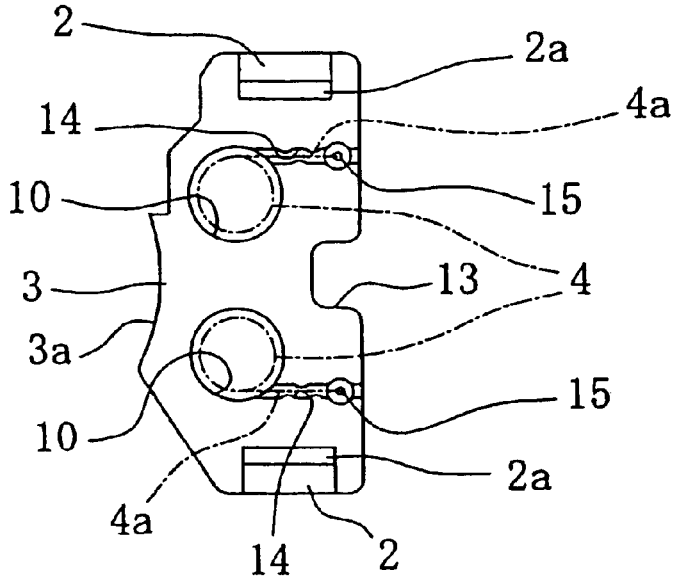
FIG. 5 is a plan view of a box member of the connector.
Figure 6:
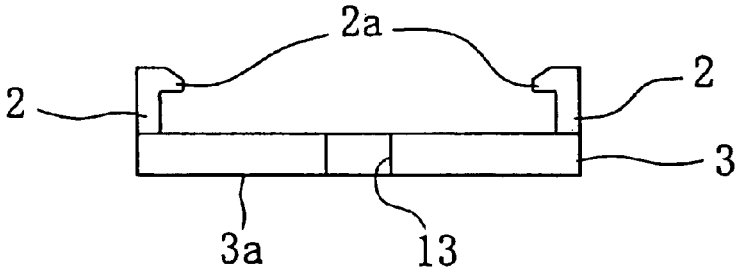
FIG. 6 is an end view viewed from the right side of FIG. 5.
Figure 7:
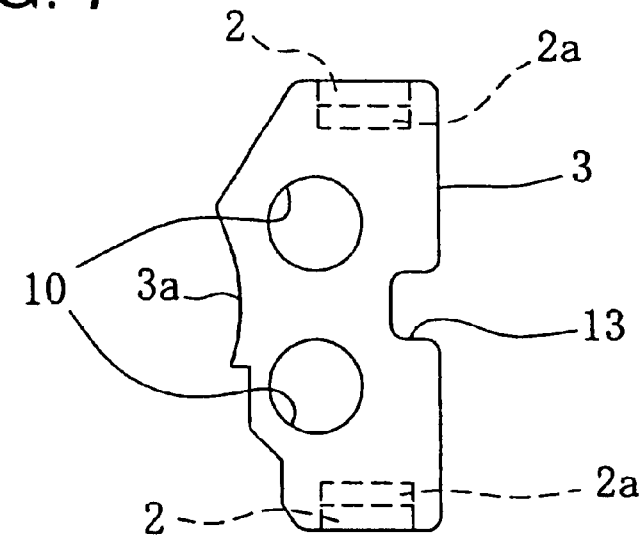
FIG. 7 is a backside view of FIG. 5.

On the other hand, the box-shaped member 3 is provided, as shown in FIGS. 5 to 7, with a block piece 3*a* of substantially rectangular parallelepiped shape overlapped with the plate member 9 of the frame structure 1 and engagement pieces 2 projecting from both longitudinal sides of the block piece 3*a*. It is desired for the box-shaped member 3 to be formed of synthetic resin as an integral structure. The block piece 3*a* is formed, at its central portion, with two cylindrical through holes 10, 10 so as to oppose to the terminal 5 on the plate member 9 when the block piece 3 is overlapped with the plate member 9 of the frame 1. The engagement pieces 2 have front ends formed as hook portions 2*a* bent so as to face each other.

As shown in FIG. 4, the plate member 9 is formed, at its both side edges, with recessed portions 11 to be engaged with the hook portions 2*a* of the engagement pieces 2 of the frame 1. The plate member 9 is further formed, at its front end, with a projection 12, and a cutout 13 to be engaged with this projection 12 is formed to an end portion of the block piece 3*a* so as to correspond to the projection 12. The engagement between the projection 12 and the cutout 13 can prevent the box member 3 from coming off from the plate member 9.

At a time when the box member 3 is pushed against the plate member 9, the block piece 3*a* and the engagement pieces 2 are flexed, so that the engagement pieces 2 on the side of the box member 3 are engaged with both the side edges of the plate member 9 on the side of the speaker. At the same time, the projection 12 of the plate member 9 is fitted into the cutout 13 of the block piece 3*a* to thereby firmly fix the box member 3 to the speaker side.

Figure 8:
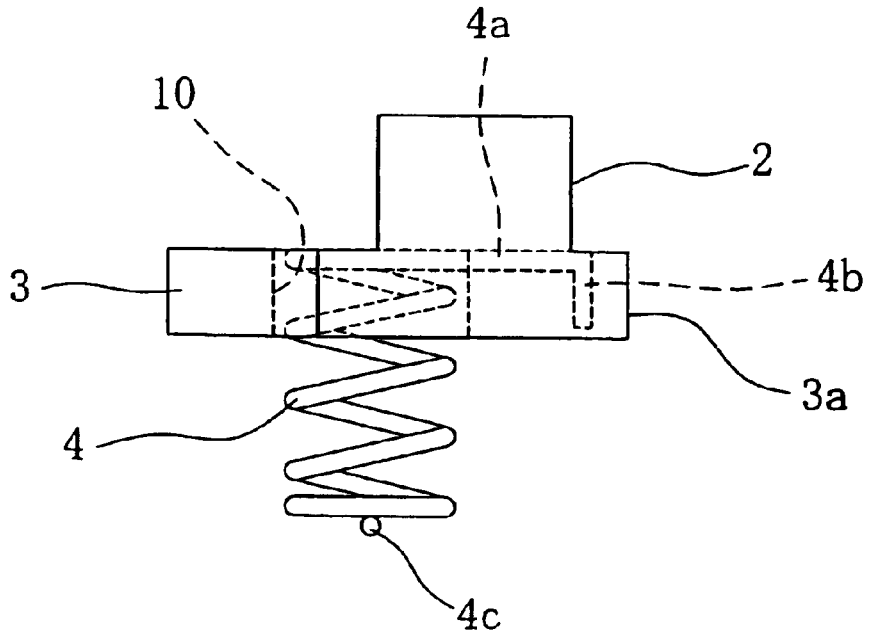
FIG. 8 is a side view showing a state that the box member of FIG. 5 is mounted with a conductive wire in form of coil spring.
Figure 9A:
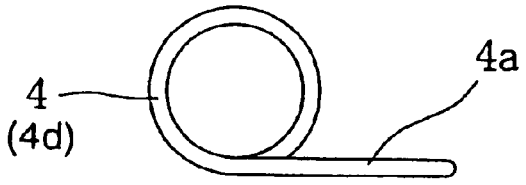
FIGS. 9A, 9B and 9C are plan, front and bottom views of the coil spring-shaped conductive wire, respectively.
Figure 9B:
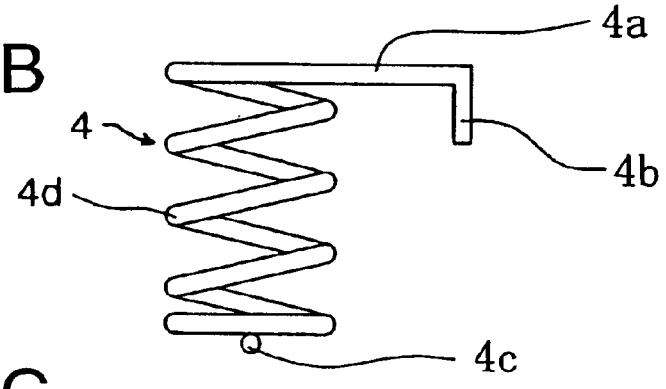
Figure 9C:
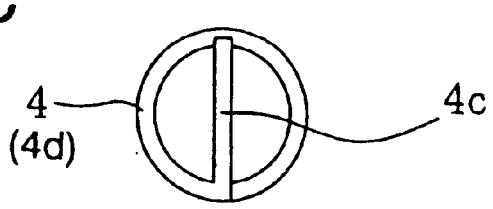

The conductive coil spring wires 4 are inserted into the through holes 10 formed to the box member 3, respectively, in a fashion shown in FIG. 8. With reference to FIG. 9 (9B), the coil spring wire 4 comprises a coil portion 4*d*, a linear portion 4*a* extending at one end of the coil portion 4*d* along the block piece 3*a* of the box-shaped member 3, a bent portion 4*b* bent at the distal end of the linear portion 4*a*, and a contact portion 4*c* formed at the other end of the coil portion 4*d* so as to cross the circular shape of the coil portion 4*d* and contact a terminal, not shown, of the substrate 6. This coil spring wire 4 is formed from a wire member having conductivity.

With reference to FIG. 5, the block piece 3*a* is formed with a groove 14 into which the linear portion 4*a* of the coil spring wire 4 is fitted and a hole 15 into which the bent portion 4*b* of the coil spring wire 4 is also inserted. The groove 14 extends along the surface of the block piece 3*a*, and the hole 15 extends in the thickness direction of the block piece 3*a*. Accordingly, the coil spring wire 4 is fixedly mounted to the block piece 3*a* by the engagement of the linear portion 4*a* and the bent portion 4*b* with the groove 14 and the hole 15, respectively. In such mounting, it is desirable that a binder fills the groove 14 and the hole 15 to ensure the firm engagement of the linear portion 4*a* and bent portion 4*b* therewith. According to such connection of the coil spring wire 4 to the block piece 3*a* of the box member 3, the coil spring wire 4 and the box member 3 are handled as one unit or structure, and when the box member 3 is mounted to the plate member 9 of the speaker, the liner portion 4*a* of one end of the coil spring wire 4 also contacts the terminal 5 of the speaker.

Further, as shown in FIG. 5, a pair of coil spring wires 4, 4 are used for one connector, and these spring coil wires 4, 4 are symmetrically arranged but have different shapes. The coil spring wire 4 shown in FIG. 9 is one for the insertion into one through hole 10 disposed on lower side in FIG. 5, and on the other hand, the other one coil spring wire 4 to be inserted into the other one through hole 10 disposed on the upper side in FIG. 5 has a linear portion 4*a* and a bent portion 4*b* having extending directions reverse to those of the coil spring wire 4 shown in FIG. 9. Of course, it is possible to use a pair of coil spring wires 4, 4 having the same shape, and in such case, one of grooves 14 and one of holes 15 formed to the box member 3 will be changed in their positions.

The substrate 6 disposed to an external portion of the speaker is a substrate on the side of the personal digital assistant such as cellular, and as shown in FIG. 3, a speaker mounted with the box member 3 and the coil spring wires 4 are pushed against the substrate 6 in a state that the speaker is held by a predetermined support member 16. The coil portion 4*d* of the coil spring wire 4 projecting from the speaker side is elastically deformed by a compression force caused by this pushing operation, and hence, the contact portion 4*c* of the other end of the coil spring wire 4 is contacted to the terminal, not shown, of the substrate 6. The coil portion 4*d* of the coil spring wire 4 is accommodated in the cylindrical through hole 10 of the box member 3, so that the coil portion 4*d* is smoothly elastically deformed, and accordingly, both the end portions of the coil spring wire 4 are properly contacted to the terminal 5 of the speaker side substrate 7 and the personal digital assistant side terminal, not shown.

The operation and function of the connector of the speaker having the structure mentioned above will be described hereunder.

With reference to FIGS. 7 and 8, the paired coil spring wires 4, 4 are inserted into the through holes 10, 10 formed to the box member 3 in the manner such that the linear portions 4*a*, 4*a* and the bent portions 4*b*, 4*b* are fitted and inserted into the grooves 14, 14 and the holes 15, 15 of the box-shaped member 3, respectively. According to this manner, the paired coil spring wires 4 are firmly fixed to the box member 3 so as not to be separated therefrom.

The box member to which the coil spring wires 4, 4 are mounted is pressed against the plate member 9 from the lower side thereof. In this operation, according to this pressing force, the block piece 3*a* of the box member 3 and the paired engagement piece 2 are elastically deformed so as to engage the engagement pieces 2 with both side edges of the plate member 9. Further, in this engaging operation, the hook portions 2*a* formed to the front ends of the engagement pieces 2 are fitted into the recesses 11 formed to the plate member 9, so that the box member 3 bites the plate member 9. In addition, the projection 12 of the plate member 9 is fitted into the cutout on the side of the box member 3, thus preventing the box member 3 from sliding on the plate member 9 and coming off therefrom.

Upon the fitting of the box member 3 to the plate member 9, the linear (straight) portion 4*a* of the one end of the coil spring wire 4 simultaneously contacts the terminal 5 on the plate member 9 on the side of the speaker. According to such operation, the coil spring wire 4 is electrically connected to the substrate 7 on the side of the speaker. Further, the other end of the coil spring wire 4 projects, as shown in FIG. 8, outside the box member 3.

When the speaker in this state is supported by the predetermined support member 16, as shown in FIG. 3, and approaches the substrate 6 on the personal digital assistant side, the coil spring wire 4 is elastically deformed and the contact portion 4*c* at the other end of the coil spring wore 4 contacts a terminal, not shown, of the substrate. According to such operation, the speaker side substrate 7 becomes electrically conductive to the personal digital assistant side substrate 6.

In an occasion that the specification of the speaker is changed and the distance between the speaker side terminal 5 and the substrate 6 is thereby changed, another box member 3 to which another coil spring wire 4 having different length will be prepared and this box member will be mounted to the plate member 9 of the speaker. Furthermore, since the connector according to the present invention is easily mounted or dismounted by means of the engagement pieces 2, the connector can be easily exchanged or re-used.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2001-325106 filed on Oct. 23, 2001 including the specification, claims, drawings and summary is incorporated herein by reference in its entirety.

What is claimed is:

1. A connector for a speaker having a frame member comprising:

a box-shaped member including a block piece and an engaging member through which the box-shaped member is secured to the frame member of the speaker;

a conductive wire in the form of a coil spring supported by the box-shaped member, said conductive wire having one end contacting a terminal provided on the frame member of the speaker when said box-shaped member is secured to the frame member of the speaker and another end projecting outward of the box-shaped member, when secured to the frame member, so as to contact a substrate of the speaker;

said engaging member of the box-shaped member projects outward from the box-shaped member and comprises a pair of engagement pieces; and said speaker has a plate member projecting from the frame member thereof, said plate member having side edge portions with which said engagement pieces are respectively engaged.

2. A connector for a speaker according to claim 1, wherein said conductive wire has one end secured to the box-shaped member.

3. A connector for a speaker according to claim 2, wherein said conductive wire comprises a coil portion, a linear portion extending from one end of the coil portion along the block piece of the box-shaped member, a bent portion bent at the distal end of the linear portion, and a contact portion formed at another end of the coil portion.

4. A connector for a speaker according to claim 3, wherein said block piece of the box-shaped member is formed with a groove to which said linear portion of the conductive wire is fitted and a hole into which said bent portion of the conductive wire is fitted.

5. A connector for a speaker according to claim 1, wherein said box-shaped member is formed with a pair of through holes into which a pair of said conductive wires are fitted, respectively.

6. A connector for a speaker according to claim 1, wherein said box-shaped member is integrally formed of synthetic resin.

7. An assembly comprising, in combination, a speaker and a connector for the speaker, said speaker including a frame member and a projection piece projecting outward from the frame member;

said connector including a box-shaped member provided with a block piece and an engaging member through which the box-shaped member is secured to the frame member of the speaker, and a conductive wire in the form of a coil spring supported by the box-shaped member, said conductive wire having one end contacting the terminal provided for the frame member of the speaker and another end projecting outward of the box-shaped member so as to contact a substrate of the speaker;

said engaging member of the box-shaped member projects outward from the box-shaped member and comprises a pair of engagement pieces; and said speaker has a plate member projecting from the frame member thereof, said plate member having side edge portions with which said engagement pieces are respectively engaged.

* * * * *